US010667618B2

(12) United States Patent
Distler

(10) Patent No.: US 10,667,618 B2
(45) Date of Patent: Jun. 2, 2020

(54) PORTABLE DEPLOYABLE STANCHION TO ASSIST AN INDIVIDUAL AT REST

(76) Inventor: Robert L. Distler, Gilbert, AZ (US)

( * ) Notice: Subject to any disclaimer, the term of this patent is extended or adjusted under 35 U.S.C. 154(b) by 0 days.

(21) Appl. No.: 13/506,537

(22) Filed: Apr. 25, 2012

(65) Prior Publication Data

US 2019/0274437 A1 Sep. 12, 2019

Related U.S. Application Data

(60) Provisional application No. 61/517,902, filed on Apr. 27, 2011.

(51) Int. Cl.
*A47C 16/02* (2006.01)

(52) U.S. Cl.
CPC ..... *A47C 16/025* (2013.01)

(58) Field of Classification Search
None
See application file for complete search history.

(56) References Cited

U.S. PATENT DOCUMENTS 3,696,826 A * 10/1972 Gruzalski ..... A61F 5/00 135/65
5,575,299 A * 11/1996 Bieri ..... A61H 3/00 135/66
5,787,913 A * 8/1998 Li ..... A61H 3/00 135/67
5,941,263 A * 8/1999 Bierman ..... A61H 3/02 135/66
6,712,781 B1 * 3/2004 Sheppard ..... A61F 13/041 128/845
6,799,592 B1 * 10/2004 Reynolds ..... A61H 3/02 135/74
7,303,537 B1 * 12/2007 Snyder ..... A61F 3/00 135/68
8,057,410 B2 * 11/2011 Angold ..... A61H 3/00 601/35
8,656,917 B2 * 2/2014 Gamber ..... A61F 5/3761 128/845
8,945,028 B2 * 2/2015 Kazerooni ..... A61H 3/00 601/35
9,408,443 B2 * 8/2016 Hunter ..... A61H 3/02
2007/0012826 A1 * 1/2007 Liu ..... B25H 1/04 248/129
2012/0034984 A1 * 2/2012 Jobe ..... A63K 1/00 472/85
2012/0312306 A1 * 12/2012 Miller ..... A47C 16/025 128/845
2014/0358053 A1 * 12/2014 Triolo ..... A61H 3/00 602/16
2017/0127843 A1 * 5/2017 Shaath ..... A47C 16/025
2017/0239119 A1 * 8/2017 Stewart ..... A61G 13/02

* cited by examiner

*Primary Examiner* — David E Allred
(74) *Attorney, Agent, or Firm* — Tod R. Nissele, P.C.

(57) ABSTRACT

A portable deployable stanchion assists a seated individual. The stanchion includes an elongate arcuate support base shaped and dimensioned to extend from the heel along the rear of the ankle and at least a portion of the calf of an individual. A first telescoping member is pivotally attached to the support base. A second articulating support member is attached to the support base and to the telescoping member. The telescoping member when deployed has a length in the range of twelve to twenty-four inches.

1 Claim, 6 Drawing Sheets

PORTABLE DEPLOYABLE STANCHION TO ASSIST AN INDIVIDUAL AT REST

This application claims priority based on provisional patent application 61/517,902, filed Apr. 27, 2011.

This invention relates to apparatus to provide support for portions of the body.

A long existing motivation in the fields of athletics, physical fitness, and physical therapy is to develop improved apparatus to support portions of the body at rest and to help portions of the body recover and heal while at rest.

Accordingly, it would be highly desirable to provide an improved apparatus to assist support of the body and to provide methods to utilize the same.

Therefore it is a principal object of the invention to provide an improved physiological support apparatus and methods for utilizing the same.

These and other, further and more specific objects of the invention will be apparent to those skilled in the art from the following detailed description thereof, taken in conjunction with the drawings, in which.

Briefly, in accordance with the invention, I provide an improved portable deployable stanchion to assist a seated individual at rest. The stanchion comprises an elongate arcuate support member shaped and dimensioned to extend from the heel along the rear of the ankle and at least a portion of the calf of an individual; a first telescoping member pivotally attached to the support member to pivot between at least two operative positions, a first collapsed stowed operative position adjacent and generally parallel to the elongate arcuate support member, and, a second distended deployed operative position with the telescoping member generally normal to said support member; a second articulating support member including a first linkage member pivotally attached at a first end to the support member, and a second linkage member pivotally attached at a primary end to a second end of the first linkage member and pivotally attached at a secondary end to said telescoping member. The second articulating support member pivots between at least two operative positions, a primary folded stowed operative position generally parallel to the support member, and a secondary unfolded operative position. In the secondary unfolded operative position, the second articulating support member is canted with respect to said support member; and, extending from the support member to the first telescoping member to support the first telescoping member in the second distended deployed operative position.

In another embodiment of the invention, I provide an improved portable deployable stanchion to assist a seated individual at rest. The stanchion includes an elongate arcuate support base shaped and dimensioned to extend from the heel along the rear of the ankle and at least a portion of the calf of an individual; and, includes a first elongate telescoping unit pivotally attached to the support base to pivot between at least two operative positions, a first collapsed stowed operative position adjacent and generally parallel to the elongate arcuate support base, and, a second distended deployed operative position with the telescoping member generally normal to the support base. The stanchion also includes a second elongate support unit including a first member pivotally attached at a first end to the support base, and a second member connected at a primary end to a second end of the first member and pivotally attached at a secondary end to the telescoping member. The second support unit pivots between at least two operative positions, a primary collapsed stowed operative position generally parallel to the support base, and a secondary distended operative position canted with respect to the support base, and extending from the support base to the first telescoping member to support the first telescoping member in the second distended deployed operative position.

Figure 1:
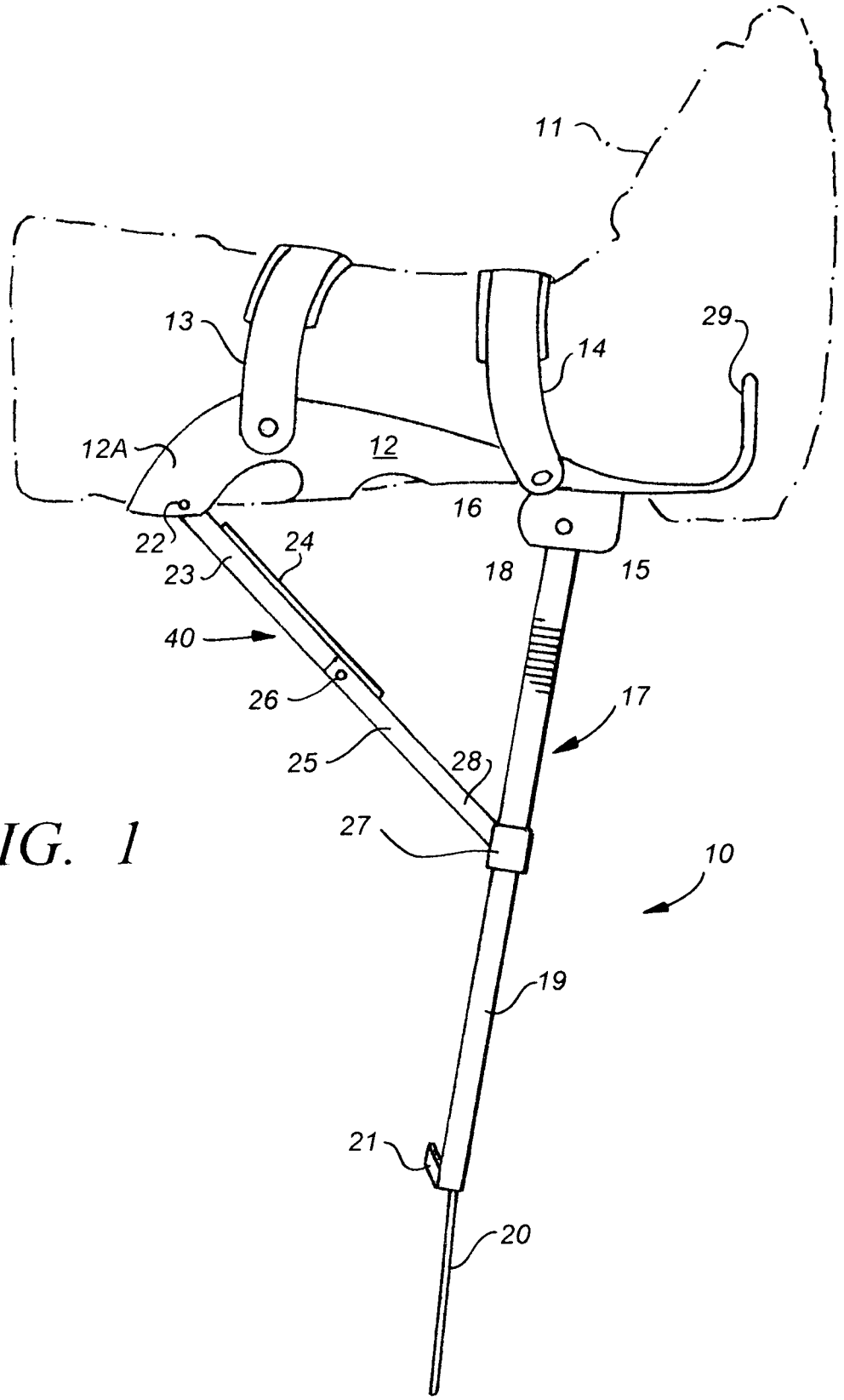
FIG. 1 is a side view illustrating a portable deployed stanchion constructed in accordance with the principles of the invention and mounted on a boot.

Turning now to the drawings which are provided by way of example and not limitation of the invention and in which like reference characters refer to corresponding elements throughout the several views, FIG. 1 illustrates a portable deployable stanchion to assist a seated individual at rest and generally indicated by reference character 10. Stanchion 10 includes an elongate arcuate support base 12 shaped and dimensioned to extend from the heel along the rear of the ankle and at least a portion of the calf of an individual. Arcuate base 12 preferably generally conforms to footwear worn by an individual, or conforms to the individual's anatomy.

The lower end of support base 12 includes a tongue 29 which is, when the individual wearing stanchion 10 is seated and stanchion 10 is deployed in the manner illustrated in FIG. 1, generally vertically oriented, and which extends under the heel of a boot worn by an individual, extends under the heel of a shoe worn by the individual, extends under the heel of other footwear worn by the individual, or, in the event the individual is not wearing footwear, extends under the heel of the foot of the individual, as the case may be. Base 12 includes an outer surface 12A visible in FIGS. 1 to 5, and includes an inner surface 12B visible in FIG. 6.

Stanchion 10 also includes a first telescoping unit 17 pivotally attached to the outer surface 12A of support base 12 to pivot between at least two operative positions, a first collapsed stowed operative position adjacent and generally parallel to the elongate arcuate support base 12, and, a second distended deployed operative position with the telescoping unit 17 generally normal to the support base 12.

Figure 2:
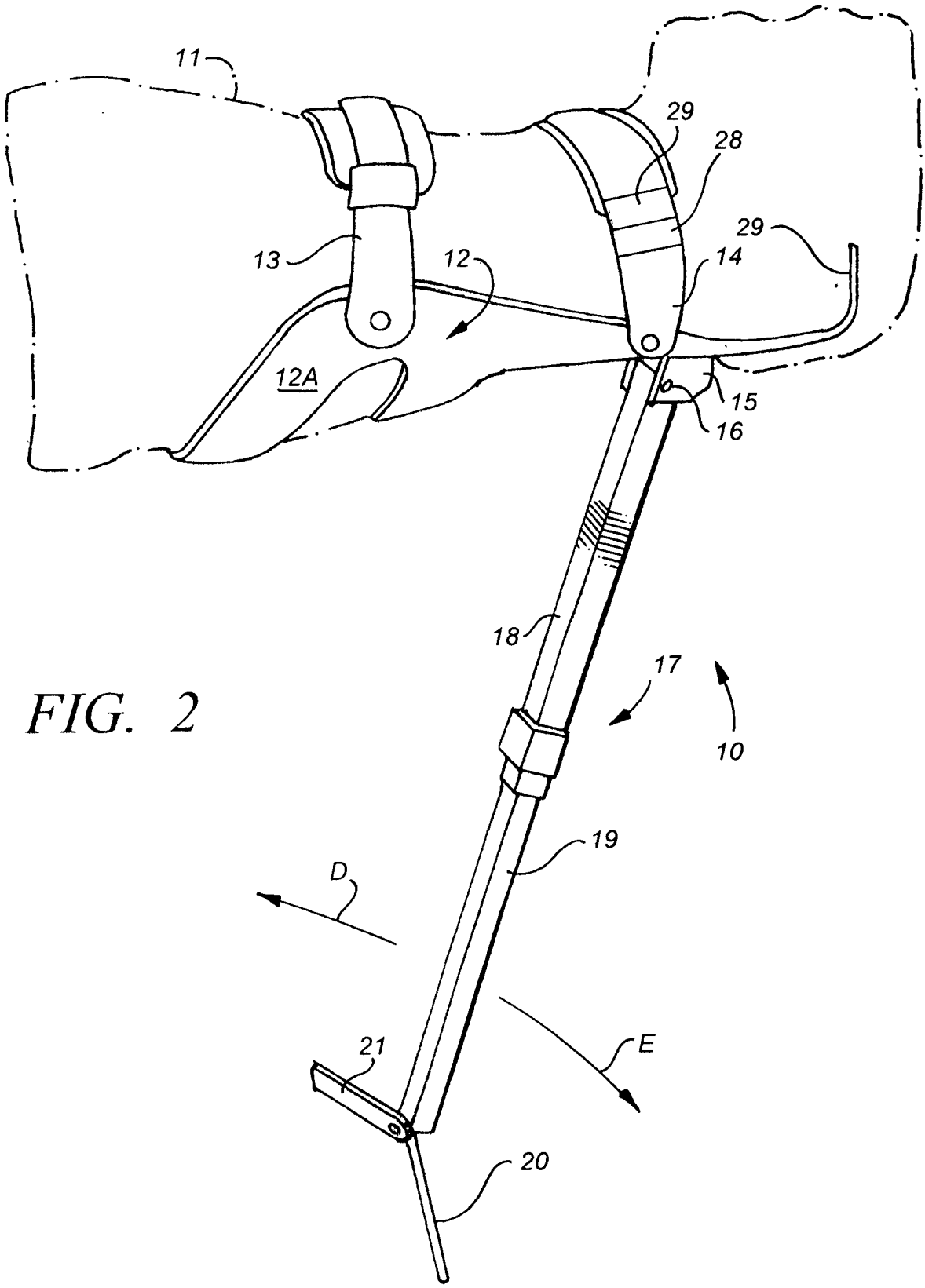
FIG. 2 is a side rear view further illustrating the portable deployed stanchion of FIG. 1.
Figure 5:
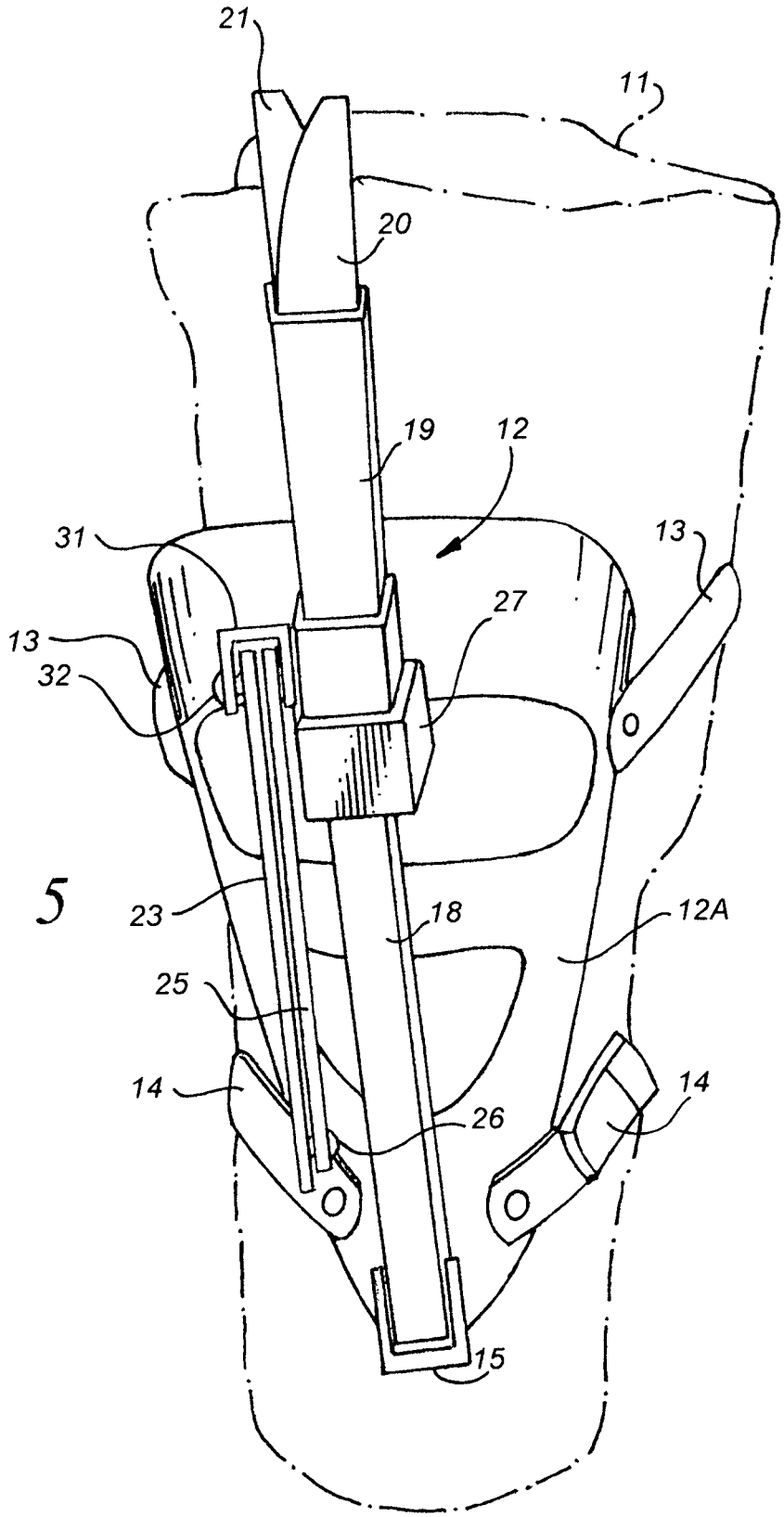
FIG. 5 is a rear view of the portable stanchion of FIG. 1 in a stored orientation; and, FIG. 6 is a rear view of the stanchion of FIG. 1.
Figure 6:
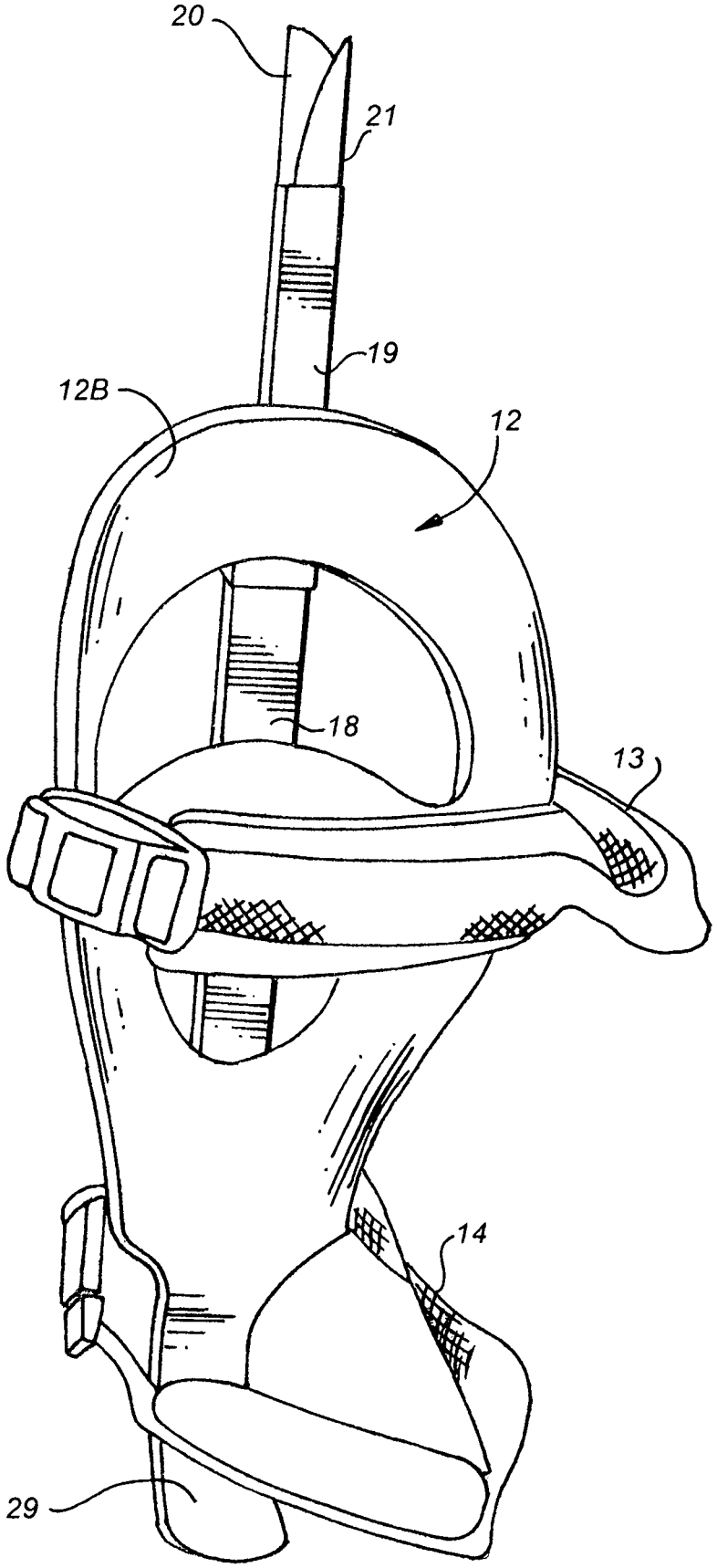

Telescoping unit 17 is illustrated in the first collapsed stowed operative position in FIGS. 5 and 6. The second distended deployed operative position of telescoping unit 17 is illustrated in FIGS. 1 to 3.

Stanchion 10 also includes a second articulating support unit 40 which includes a first member 23 pivotally attached 22 at a first end to the outer surface 12A of the base 12, and includes a second member 25 pivotally attached 26 at a primary end to a second end of the first member and pivotally attached 27 at a secondary end to collar 27 of the telescoping unit 17.

The second articulating support unit 40 pivots between at least two operative positions, a primary folded stowed operative position generally parallel to the base 12, and a secondary unfolded operative position. In the secondary unfolded operative position, the second articulating support unit 40 is generally linearly oriented and is canted with respect to the base 12, and extends from the base 12 to the first telescoping unit 17 to support said first telescoping unit 17 in its second distended deployed operative position.

Figure 3:
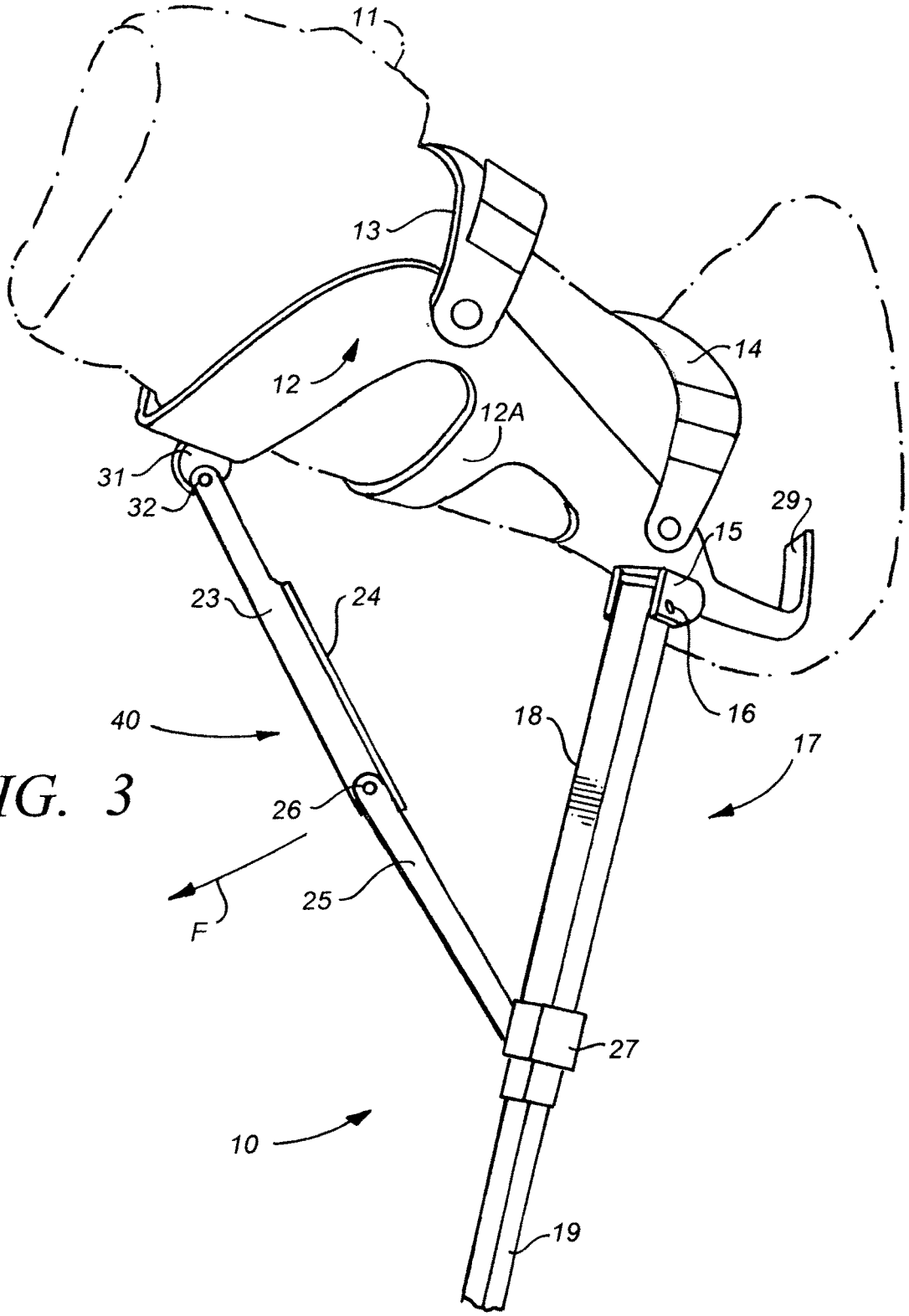
FIG. 3 is a side rear view further illustrating the portable deployed stanchion of FIG. 1.

FIGS. 1 and 3 illustrate unit 40 in its secondary unfolded operative position. FIG. 5 illustrates unit 40 in its primary folded stowed operative position.

Figure 4:
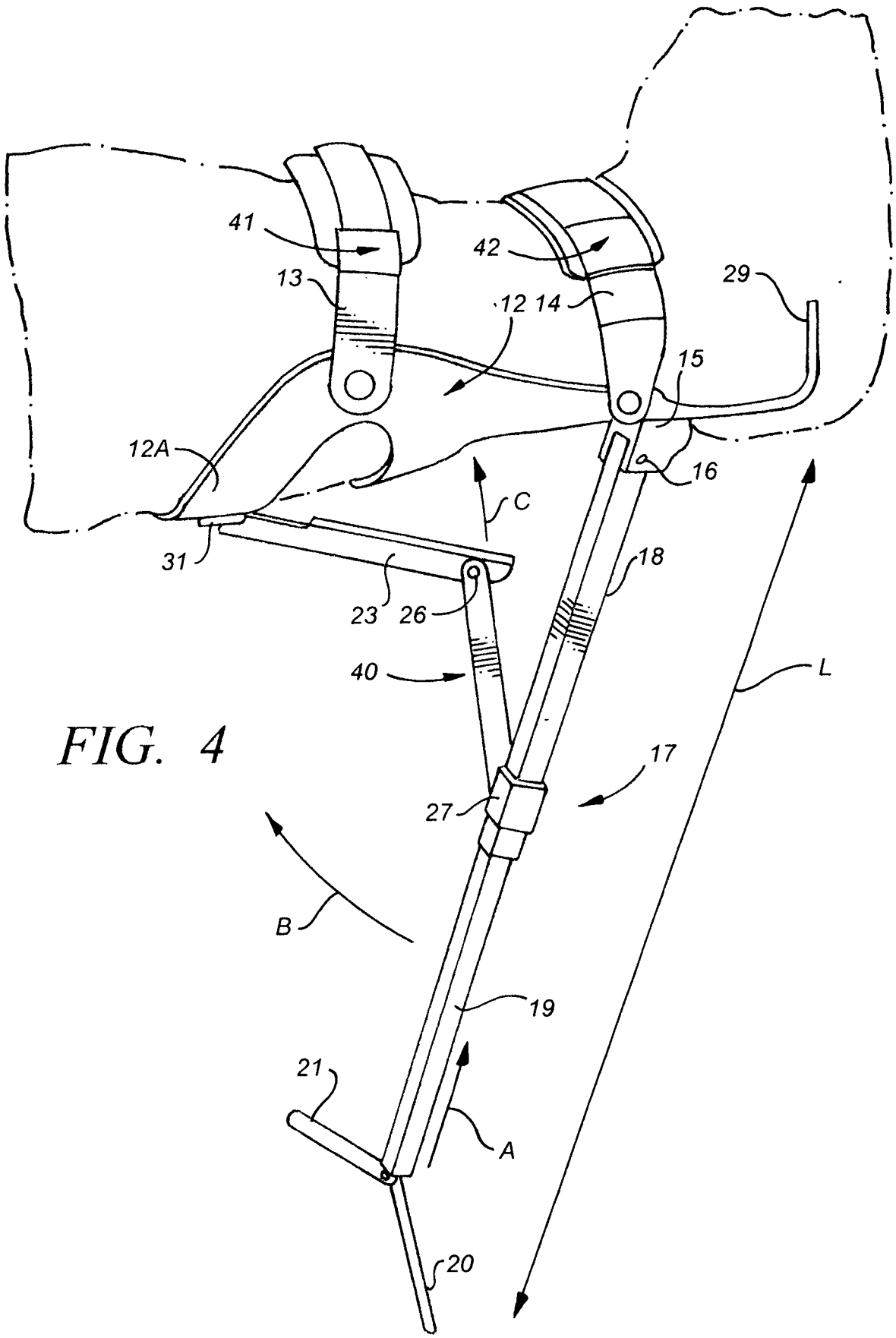
FIG. 4 is a side view of the portable stanchion of FIG. 1 being folded into a stowed orientation.

FIG. 4 illustrates unit 40 partially folded when unit 40 is being moved from its secondary to primary operative position and when unit 17 is being moved from its second distended deployed operative position to its first collapsed stowed operative position.

In the first collapsed stowed operative position, a large portion of hollow tubular member 19 slides into hollow tubular member 18 in the manner indicated by arrow A (FIG. 4), and a portion of each of each of the spring loaded feet 20 and 21 slides into member 19 in the manner indicated in FIGS. 5 and 6.

When unit 40 folds from its secondary unfolded operative position to its primary folded stowed operative position, member 23 pivots toward outer surface 12A. In the direction indicated by arrow C in FIG. 4. When unit 40 unfolds from its primary folded stowed operative position to its secondary unfolded operative position, member 23 pivots about point 31 in a direction opposite that of the direction indicated by arrow C and in a direction away from base 12.

When unit 17 folds from its second distended deployed operative to its first collapsed stowed operative position, unit 17 pivots toward the outer surface 12A of base 12 in the direction indicated by arrow B in FIG. 4. When unit 17 folds from its first collapsed stowed operative position to its second distended deployed operative position, unit 17 pivots in a direction opposite that indicated by arrow B and pivots about point 16 in a path away from base 12.

Straps 13 and 14 each extend around a portion of an individual's ankle, leg, and/or boot to secure removably stanchion 10 in position on the individual. Each strap includes a buckle 41, 42 (FIG. 4) which can be opened and closed so that stanchion 10 can be readily removed from an individual's leg by unbuckling the buckles and can be readily mounted on an individual's leg by placing base 12 against the back of the individual's leg (or boot or other footwear) in the position illustrated in FIGS. 1 to 5, by wrapping the free ends of each strap 13 and 14 around the leg to the position generally indicated in FIGS. 1 to 5, and by then fastening the releasable buckle 41 and 42 on the free end of each strap 13 and 14, respectively, to secure stanchion 10 on the individual's leg.

When telescoping unit 17 is in the deployed position illustrated in FIG. 4, the overall length, indicated by arrow L, can vary as desired. However, since stanchion 10 is intended to be utilized primarily when an individual is seated in a chair, the length L is preferably in the range of twelve to twenty-four inches, this because the top, or upper surface, of the seat in many or most chairs is typically about eighteen to nineteen inches above the ground on which the chair stands and on which feet 20, 21 rest when unit 17 is deployed. Telescoping unit 17 can, if desired, be constructed such that the length L of unit 17 when deployed is adjustable. In the presently preferred embodiment of the invention, the length of unit 17 is fixed and is not adjustable.

In use, stanchion 10 can be mounted on the leg of an individual and remain on the individual's leg while the individual travels. Once the individual reaches a desired location and takes a seat, members 17 and 40 can be deployed in the manner illustrated in FIG. 1 such that feet 20 and 21 rest on the ground and stanchion 10 supports the individual's leg above the ground in a generally horizontal orientation. Feet 20 and 21 function to help prevent member 17 from tilting laterally in the directions indicated by arrows D and E in FIG. 2. Preventing the lateral tilting of member 17 is important because when an individual is seated and stanchion is deployed in the manner illustrated in FIGS. 1 to 4, it is desirable to prevent the individual's boot 11 (or leg) from traveling laterally to the left or right of the individual, i.e., it is important to keep the individual's leg elevated in the manner illustrated in FIG. 1 and to keep the individual's leg located at the front of the seated individual.

Telescoping unit 17 can be constructed in any desired manner to maintain unit 17 in its deployed position. For example, a quick release pin can secure member 19 in its deployed position, or, a spring loaded ball bearing can be utilized. Such a ball bearing would be mounted on member 18 and, when member 19 is slid out of member 18 to the position shown in FIG. 1, would extend into an opening formed in member 19. When the time comes to collapse member 19 back into member 18, the ball bearing is pressed inwardly out of the opening formed in member 19 and back into member 18 to permit member 19 to slide into member 18. Such spring loaded ball bearings are common in collapsible legs used in camping tents, awnings, and shelters.

In FIG. 3, the end of member 25 at pivot 26 bears against upstanding lip 24 formed on member 23. Lip 24 acts as a stop which prevents member 23 from pivoting about pivot 26 further in the direction of arrow F.

In one embodiment of the invention, articulating unit 40 is replaced by a supplemental telescoping unit comparable to unit 17. When such a supplemental telescoping unit is, however, deployed or distended in the manner of unit 40 in FIG. 1, the supplemental unit normally has a length which is less than the length of unit 17 when unit 17 is deployed in the manner illustrated in FIG. 1. Similarly, when unit 40 is deployed in the manner illustrated in FIG. 1, the length of unit 40 is necessarily normally less than the length of unit 17.

In FIGS. 5 and 6, tubular member 19 is not completely slidably collapsed into member 18. The degree to which member 19 slidably collapses and is housed in member 18 can vary as desired.

In the drawings, telescoping unit 17 has only two tubular members 18, 19. As would be appreciated by those of skill in the art, the number of telescoping members comprising unit 17 can vary as desired and ca be three, four, etc. In one embodiment of the invention, when unit 17 is distended to the deployed position, the length of unit 17 is, when an individual utilizing stanchion 10 is seated, sufficient to position the individual's foot above his heart.

Having described the invention and presently preferred embodiments and the best modes thereof in such terms as to enable one of skill in the art to make and use the invention, I claim:

1. A portable deployable stanchion to assist a seated individual at rest, comprising (a) an elongate arcuate support base shaped and dimensioned to extend from a heel portion along a rear of an ankle portion and a calf portion of the support base, adapted to support a calf of an individual;

(b) a first elongate telescoping unit pivotally attached to said support base to pivot between at least two operative positions, including (i) a first collapsed stowed operative position adjacent and generally parallel to said elongate arcuate support base, and, (ii) a second distended deployed operative position with said telescoping unit generally normal to said support base;

(c) a second elongate support unit including (i) a first member pivotally attached at a first end to said support base, (ii) a second member connected at a primary end to a second end of said first member and pivotally attached at a secondary end to said telescoping unit, said second support unit pivoting between at least two operative positions, said second support unit including (i) a primary collapsed stowed operative position generally parallel to said support base, and (ii) a secondary distended operative position canted with respect to said support base, and extending from said support base to said first telescoping unit to support said first telescoping unit in said second distended deployed operative position.

* * * * *